United States Patent [19]

Scuderi

[11] Patent Number: 4,571,106

[45] Date of Patent: Feb. 18, 1986

[54] SUN LOTION APPLICATOR

[76] Inventor: Richard Scuderi, 12 S. Benson, Box 3323, Margate, N.J. 08402

[21] Appl. No.: 569,409

[22] Filed: Jan. 9, 1984

[51] Int. Cl.[4] ..... A45D 34/04

[52] U.S. Cl. ..... 401/209; D9/338; 401/6; 401/213; 215/1 R

[58] Field of Search ..... 401/209, 213, 6; 215/1 R; 604/310; D9/338; 128/57, 67

[56] References Cited

U.S. PATENT DOCUMENTS

| | | | |
|---|---|---|---|
| D. 180,715 | 7/1957 | Henry et al. | D86/10 |
| D. 183,760 | 10/1958 | Meadows | D58/6 |
| D. 218,731 | 9/1970 | Eisermann | D9/1 |
| D. 248,214 | 6/1978 | DiNuccio | D9/1 |
| D. 250,248 | 11/1978 | Grip | D9/1 |
| D. 256,666 | 9/1980 | Sardá | D9/72 |
| D. 263,118 | 2/1982 | Weckman | D9/341 |
| D. 264,179 | 5/1982 | Dach | D9/319 |
| 1,163,888 | 12/1915 | Bye | 215/1 R |
| 2,103,261 | 12/1937 | Hughes | 128/57 |
| 2,749,566 | 6/1956 | Thomas | 15/132.7 |
| 2,883,690 | 4/1959 | Holler | 15/132.7 |
| 2,976,561 | 3/1961 | Culver | 15/572 |
| 2,981,968 | 5/1961 | Schaich | 15/572 |
| 2,997,731 | 8/1961 | Schultz . | |
| 3,048,881 | 8/1962 | Ackerman | 15/572 |
| 3,355,241 | 11/1967 | Rowe | 401/213 |
| 4,021,125 | 5/1977 | Berghahn et al. | 401/213 |
| 4,168,128 | 9/1979 | Fillmore et al. | 401/213 |
| 4,225,254 | 9/1980 | Holberg et al. | 401/6 X |
| 4,326,508 | 4/1982 | Stauffer | 128/57 |

FOREIGN PATENT DOCUMENTS

| | | | |
|---|---|---|---|
| 845166 | 8/1939 | France | 215/1 R |
| 1208236 | 2/1960 | France | 401/209 |
| 624 | 4/1915 | Netherlands | 215/1 R |

*Primary Examiner*—Steven A. Bratlie
*Attorney, Agent, or Firm*—Thomas A. Lennox

[57] ABSTRACT

A spherical ball applicator is provided to apply lotions to the human body for protection from the rays of the sun which may include an elongated body shape wherein one end of the applicator can be held to apply lotion from the other end to the more inexcessible areas of the body.

5 Claims, 4 Drawing Figures

SUN LOTION APPLICATOR

BACKGROUND OF THE INVENTION

This invention relates to a roll-on ball applicator and specifically the use for the application of lotion or oil for the protection of exposed body surfaces from harmful sun rays. A specific embodiment includes an extended container body shape to allow reaching the ball applicator to the most inaccessible portions of the skin, such as the small of the back between the shoulders.

Anyone who has spent time on a sandy beach in the summer time is aware of the difficulties in protecting the skin from harmful sun's rays. Oils, lotions, solutions, home made liquid preparations and commercial preparations are widely used to protect the exposed portions of the body from the harmful sun rays. Sun blocks which absorb the ultraviolet rays are commonly used for added protection of the body. Throughout the specification and claims, the word "lotion" is intended to include all such preparations including all the physical forms and chemical compositions used to protect the skin from the elements.

A continuing and bothersome problem encountered in applying lotion to the body is the necessity of using your hands to apply the lotion and the difficulty of applying it evenly over the entire body. Bottles holding the lotion typically come in contact with the sand and even if you have just come out of the water, picking up the bottle immediately transfers sand to the hand surface which will be used to apply the lotion. There is a need to have an applicator which can be used to apply the lotion to all exposed portions of the body while freeing up at least one hand that never need touch the container. If the lotion is attempted to be applied by the hands, it is essentially impossible to apply the lotion to the entire body with only one hand. This involves touching the present style lotion containers with both hands ending up applying sand together with the lotion over the body. Finally, it is impossible for most persons to reach significant portions of their body and while most persons can not reach the small of their back, many older persons or persons with limited movement do to an infirmity or an accident can reach only limited areas.

Ball type dispensers are described and illustrated in the following patents but none teach or suggest the use as an applicator for sun protection lotion and none provide a solution for the needs described above nor satisfy the objects of the invention listed herein below. The patents describing various dispensers using rolling ball devices include: U.S. Pat. Ser. No. 2,749,566 to R. H. Thomas, U.S. Pat. No. 2,9796,561 to R. M. Culver, U.S. Pat. No. 4,326,508 to R. Stauffer, U.S. Pat. No. 2,883,690 to E. J. Holler, Jr., U.S. Pat. No. 3,048,881 to E. M. Ackerman, U.S. Pat. No. 2,981,968 to W. A. Schaich, U.S. Pat. No. 2997,731 to R. S. Schultz, U.S. Pat. No. 4,168,128 to W. E. Fillmore and G. V. Mumford, U.S. Pat. No. 4,021,125 to W. G. Berghahn and J. Weinstein, U.S. Pat. No. Des. 264,179 to H. Dash, U.S. Pat. No. Des. 248,214 to D. P. DiNuccio, U.S. Pat. No. Des. 220,249 to J. Gould, U.S. Pat. No. Des. 250,248 to J. A. Grip, U.S. Pat. No. Des. 183,760 to R. Meadows, U.S. Pat. No. Des. 180,715 to R. Henry and H. Poris, U.S. Pat. No. Des. 218,731 to K. Eisermann, U.S. Pat. No. Des. 256,666 to E. Sarda, and U.S. Pat. No. Des. 263,118 to R. Weekman.

SUMMARY OF THE INVENTION

An object of this invention is to provide an applicator for lotion to protect the body from harmful sun rays which does not necessitate using the hands to spread the liquid over the body.

It is an additional object of this invention to provide an applicator to apply lotion to the skin while outdoors without danger of spilling or causing it to be adulterated while being placed on the ground.

It is an additional object of this invention to provide an applicator for lotion to reach all areas of the body that might be exposed to the sun.

It is a further object of this invention to provide an applicator container which will rest on a somewhat uneven surface and not easily tip over to contact the applicator head with sand or soil.

It is an additional object of this invention to combine an applicator to reach inexcessible areas of the body surface with the need for storage capacity of the lotion to be applied.

It is a further object of this invention to provide a container with an extension handle with a surplus storage capacity in the handle that drains to a base supply area contiguous with an applicator head.

It is an additional object of this invention a device that combines use as an applicator and as a massage element to reach muscles of the back normally inaccessible.

An important object of this invention is to provide an applicator that will deposit a uniform film of lotion on the body and avoid spillage and loss of lotion.

Finally it is an object of this invention to provide an applicator for a lotion which may be applied with one hand to essentially all parts of the body.

The invention is an applicator device to apply liquid including a container having an open end. A ball applicator device to apply liquid from its surface is positioned partially within the open end held in position by a restraining device to hold the ball applicator device into the open end while allowing the ball to rotate in place. The ball applicator device may be contacted by contents in the container so that when the ball applicator is rolled on the skin surface, lotion in the container is applied directly to the skin. A holding device allows the container to be hand held a distance from the ball applicator device. The applicator is used to apply lotion formulated to be applied to and to protect the exposed skin of the human body from the harmful rays of the sun.

DESCRIPTION OF PREFERRED EMBODIMENTS

Figure 1:
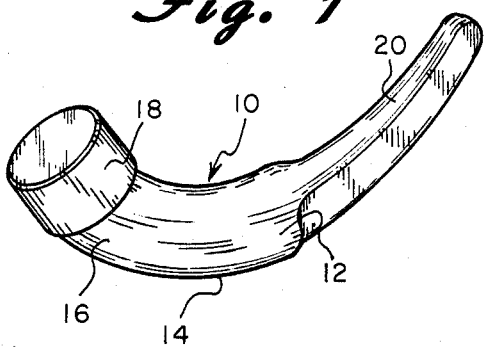
FIG. 1 is a perspective view of an applicator of this invention.
Figure 2:
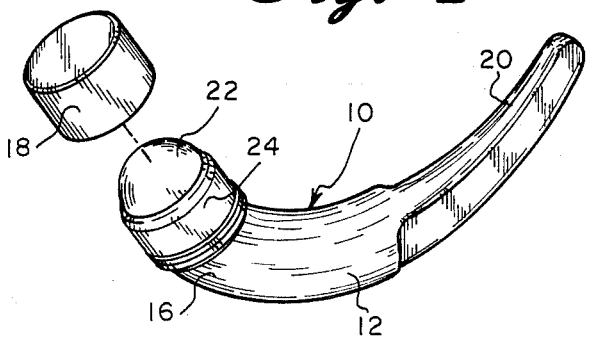
FIG. 2 is a perspective view of the same applicator with the cap removed to show the applicator ball.
Figure 3:
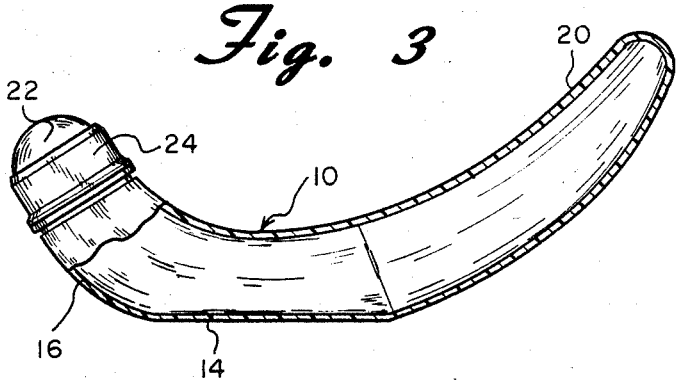
FIG. 3 is a partial cross-sectional view of the applicator illustrated in FIG. 2.
Figure 4:
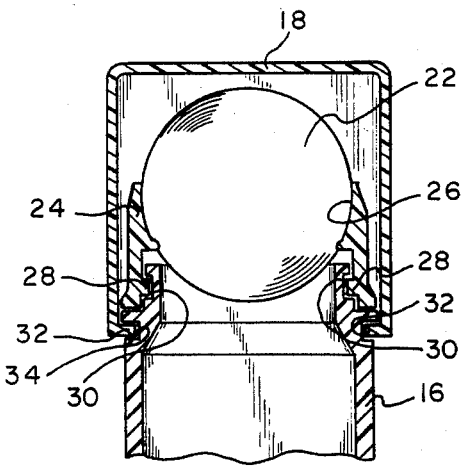
FIG. 4 is an expanded vertical cross-sectional view of the applicator head with the cap in place.

An applicator 10 of the present invention is illustrated in the perspective views of FIGS. 1 and 2. The main portion of applicator 10 is the hollow body 12 constructed of a thermoplastic polymer using standard container manufacturing methods. Body 12 may be composed of an injection molded or blow molded thermoplastic polymer such as polyvinyl chloride, rigid or plasticized, polyolfins or various impact resistant polystyrene or acrylic polymers. Theplastic may be opaque, translucent or even essentially transparent and may be colored or colorless. Body 12 includes base surface 14 which is flattened and relatively large to provide stability when applicator 10 is placed down. In addition, the position and shape of base surface 14 allows most of the contents of applicator 10 to flow to a position close to front body extension 16 which extends upwardly toward applicator ball 22. Thus, when applicator 10 is picked up and ball 22 is positioned downwardly, for application of lotions contained in body 12, there is little flow distance required to contact the surface of ball 22. Holding ring 24 holds ball 22 and is snap fitted into the opening of front body extension 16. Rear body extension 20 extends upwardly and at angle to base surface 14 away from applicator ball 22. In normal use, particularly when the more inaccessible areas of the body must be reached, the terminal end of rear body extension 20 is grasped with the hand allowing the full length of applicator 10 to be utilized to reach that part of the body in need of application and/or massage. In FIG. 2, cap 18 is shown removed to uncover the applicator surface of ball 22. The underside surface of ball 22 is in contact with the interior of body 12 and the lotion stored therein. FIG. 3 provides a partial cross-section to illustrate the hollow interior of body 12. As illustrated in FIG. 4, cap 18 snaps onto body extension 16 by shoulder 32 extending horizontally inwardly from the bottom edge of the cap to engage channel 34 extending circumferentially around the outer surface of extension 16 close to the opening of the body. Holding ring 24 also engages into a similar channel 30 closer to the upper edge of the opening of front body extension 16. Angular shoulder 28 positioned on the interior of holding ring 24 detachably engages channel 30 to hold ring 24 on the opening of body extension 16. Spherical surface 26 on the interior of holding ring 24 allows spherical ball 22 to be snapped into position and held securely while being allowed to rotate in position. In this fashion, as ball 22 is rotated in contact with lotion in body 12 a film of lotion is allowed to remain on the rotating exposed surface of ball 22, while excess is wiped off by surface 26 remaining inside the container. Ball 22 is generally solid of a rigid plastic.

Throughout the specification and claims the word "ball" is used to describe a structure of the applicating surface. It should be understood that the term "ball" is not intended to be limiting and need not be spherical in order to satisfy the purpose of applicating fluids from within the container. For example, the "ball" may be cylindrical in shape or more likely it may be oblate or even egg shaped so long as a restraining device can hold the "ball" in position and allow it to rotate to come in contact with lotion inside the container and in turn carry a film of that lotion to the outer surface for application to the skin.

It is preferred that the restraining device hold the ball and be detachably connected to the open end of the container. Since the container may be supplied empty for the purchaser to add his or her own favorite lotion, whether it be commercially prepared or not, it is important that the rolling ball applicator be detachable from the body and yet provide a satisfactory seal to prevent undue leakage. It is preferred that the restraining device be detachably connected through a detent snap into the open end. It is further preferred that the container include a base surface of sufficient size to yield stability even if the container is resting on an uneven surface. The low center of gravity of the bulk of the balance of the container prevents easy tip over. A body extension in a direction generally upwardly at an angle to the base surface terminates at the open end. This body extension preferably is angled upwardly at an angle from the base surface in the range of about 25 to 85 degrees and preferably about 50 degrees. A second body extension in a direction generally upwardly away from the open end is preferably longer and at a lower angle from the base surface than the first body extension. The angle of the second body extension from the base surface is preferably at an angle of 15 to 60 degrees, more preferably in a range of 30 to 50 degrees and most preferably at an angle of about 35 to 40 degrees. It is preferred that the base surface comprise a major portion of the body wall and it is quite acceptable to have the bulk of the body be essentially parallel with the base surface and have only the end of the extensions angled upwardly from the base surface. It is preferred that the total length of the container be of sufficient length to allow hand holding of the terminal portion of the second body extension to allow reaching the ball applicator to most inaccessible portion of skin surface. It is preferred that the extensions of the body be hollow and in communication with the contents of the container. It is preferred that the shape of the body be contoured such that the bulk of the contents that remain in the container be positioned close to the applicator end when the container is resting on the base surface. It is preferred that a cap be provided to detachably connect to cover the exposed surface of the ball.

While this invention has been described with reference to the specific embodiments disclosed herein, it is not confined to the details set forth and the patent is intended to include modifications and changes which may come within and extend from the following claims.

I claim:

1. An applicataor device to apply liquids comprising:

(a) a container comprising:

(i) an open end, (ii) a base surface, (iii) a body extension in a generally upwardly direction at an angle to the base surface terminating at the open end, and (iv) a second body extension in a generally upwardly direction at an angle to the base surface away from the open end, wherein the length of the container is sufficient to allow hand holding by a person of the terminal portion of the second body extension and reach the ball applicator means to the most inaccessible portions of the person's skin surface, such as the small of the back, and wherein the extensions are hollow and in communication with the contents of the container, (b) a ball applicator means comprising a ball to apply liquid from its surface, positioned partially within the open end, and (c) a retaining means to hold the ball in the open end while allowing the ball to rotate in place, wherein the ball applicator means may be contacted by any contents of the container.

2. The device of claim 1 wherein the retaining means is an annular ring detachably connected through a detent snap intothe open end.

3. The device of claim 1 wherein a cap is provided to be detachably connected to cover the exposed surface of the ball applicator means.

4. The device of claim 1 wherein the ball applicator means is a spherical ball.

5. The device of claim 4 wherein the ball applicator means is a solid spherical ball.

* * * * *